United States Patent [19]

Wensley et al.

[11] 4,225,164

[45] Sep. 30, 1980

[54] AUTOMATIC DOOR AND WINDOW LOCKING SYSTEM

[76] Inventors: Brian J. K. Wensley; Gillian E. Wensley, both of 10979 - 84th Ave., North Delta, British Columbia, Canada

[21] Appl. No.: 908,265

[22] Filed: May 22, 1978

[51] Int. Cl.[2] ..... E05C 1/06

[52] U.S. Cl. ..... 292/33; 292/144

[58] Field of Search ..... 292/201, 144, 33, 333, 292/DIG. 71; 70/432

[56] References Cited

U.S. PATENT DOCUMENTS

| | | | |
|---|---|---|---|
| 703,372 | 7/1902 | Beisel | 292/33 |
| 1,367,855 | 2/1921 | Bolles | 292/333 |
| 3,948,067 | 4/1976 | Peterson | 292/33 |
| 4,099,752 | 7/1978 | Geringer | 292/144 |
| 4,141,610 | 2/1979 | Ando | 292/144 |

*Primary Examiner*—Richard E. Moore

*Attorney, Agent, or Firm*—Robert H. Barrigar; Gerald O. S. Oyen; Lance A. Turlock

[57] ABSTRACT

A remotely controlled door and window locking device is provided with a plurality of deadbolts responsive to master control signals and positioned with respect to associated doors and windows so that when triggered to locked positions, all of the doors and windows connected to the system are locked. The device has retaining means preventing the movement of respective deadbolts associated with the doors and windows when the doors are left ajar or windows are left in other than a closed or predetermined open position, and display lights at a master control panel each one of which remains off when its associated door is ajar, or window is in other than a closed or predetermined open position.

11 Claims, 5 Drawing Figures

AUTOMATIC DOOR AND WINDOW LOCKING SYSTEM

BACKGROUND OF THE INVENTION

The present invention relates to a remotely controlled window and door locking device for the simultaneous locking and unlocking of the doors and windows of a house or other building.

Conventional houses and the like are generally equipped with individual locks or latches for each of their exterior doors and windows which must be locked independently before leaving the house unattended. In numerous instances one or more doors or windows are overlooked and remain as the usual entry means of a burglar. Although the locking of doors and windows would not likely discourage a professional burglar, the great majority of burglars are amateurs who would usually be dissuaded from breaking into a house which had all of its doors and windows in a locked position.

There are several known systems for simultaneously locking all of the doors in a building from a remotely located master control point in order to better ensure the locking of all such doors. U.S. Pat. No. 656,341, Carleton, Aug. 21, 1900, discloses a series of electrically operated locks simultaneously controlled from a common point, and having a plurality of respective alarms which are triggered on when locks are so operated. The latter device is designed to unlock fire escape doors in a hotel or other building, and signal the room occupant of both the operation of the locks and the existence of a fire, but is not intended for a building security system. Thus Carleton does not disclose a means for preventing operation of a lock in the event a door is left ajar, a lock which is applicable to windows as well as doors, nor does it disclose a remote indicator system to indicate when doors or windows are left ajar upon operation of the locks.

U.S. Pat. No. 2,765,648, Hatcher, Oct. 9, 1956 discloses a plurality of solenoid actuated locks adapted to be simultaneously operated from a common point and particularly designed to lock and unlock the windows and doors of a motor vehicle. The Hatcher device does not have a display to indicate when doors or windows are left open, a local control feature to allow operation of individual locks independently of the master control unit, a manual override control to allow individual doors and windows to be unlocked in the event of a power failure, or a display to indicate whether or not individual doors or windows are in an opened or locked position.

U.S. Pat. No. 3,785,187, Wolz, Jan. 15, 1974, discloses a plurality of deadbolts associated with each of a plurality of swinging doors, the swinging doors being simultaneously locked or unlocked from a remotely controlled point and a safety switch controlled by each door to prevent operation of the deadbolts until their associated door is closed, following which the associated plurality of deadbolts are automatically triggered into a locking position. Wolz also discloses the use of signal lamps at the remote control point to indicate whether each door is locked or unlocked and whether each associated deadbolt is active or inactive. However, Wolz does not describe a device applicable to windows nor does it incorporate a local control feature to allow independent unlocking of individual doors. Finally, Wolz fails to disclose a manual override control to allow unlocking of individual doors and windows in the event of a power failure.

Accordingly, it is an object of the present invention to provide a remotely controlled locking device applicable to both doors and windows, having a display proximate to a master control point to indicate whether any of the doors and windows is ajar, and a local control feature which allows independent unlocking of individual doors and windows when the master control has triggered on the locking of the device and manual override controls to unlock individual doors and windows in the event of a power failure.

It is a further object of the present invention to provide a remotely controlled locking device having retaining means to prevent movement of the locking elements when any of the doors or windows is ajar or other than in a predetermined open position.

It is a further object of the present invention to provide a remotely controlled locking device conveniently operable from a master control panel and effective to control therefrom all of the doors and windows within the locking system.

STATEMENT OF INVENTION

The present invention provides a remotely controlled locking device which features a plurality of locking elements for locking a corresponding plurality of movable wall-opening barriers (i.e., doors or windows). Each locking element has a locked and unlocked position and includes an individual lock-operating mechanism for selectably reversibly driving the locking element into the locked and unlocked position in response to "lock" and "unlock" control signals. The term "control signal" should be construed as including a zero voltage signal, which might for example be conveniently chosen as the "lock" signal if it is desired to have the doors and windows normally locked. The device also includes a master control means remotely connected to each individual lock-operating mechanism for selectively providing the latter mentioned "lock" and "unlocked" control signals. Display means are connected to each of the locking elements to display the condition (i.e. "locked" or "unlocked") of the locking element. The device also includes local control means for rendering inoperative control signals provided by the master control means to provide "unlock" signals to associated lock-operating mechanisms. Manual override controls are mechanically coupled to each locking element to allow manual movement of that element to a locked or an unlocked position.

The aforesaid locking device is intended to be electrically operated and, in a preferred embodiment described herein, is depicted as operating from alternating current line voltage, but may in fact receive its electrical power from any number of sources including a battery, generator or other standby source. Moreover, the system could be modified to operate from compressed air by replacing the electrical lines with compressed air lines and employing gas activated piston-cylinders in place of the solenoids, or alternatively, by employing electric motors in place of the solenoids. A further feature of the invention includes retaining means located adjacent to each wall opening reversibly closed by a corresponding one of the movable wall opening barriers for preventing movement of associated locking elements from an unlocked to a locked position when the associated movable wall opening barrier is in other than closed or predetermined open position. Each retaining means is responsive to "open" and "close" control signals provided by its associated movable wall-opening barrier.

DETAILED DESCRIPTION WITH REFERENCE TO THE DRAWINGS

Figure 1:
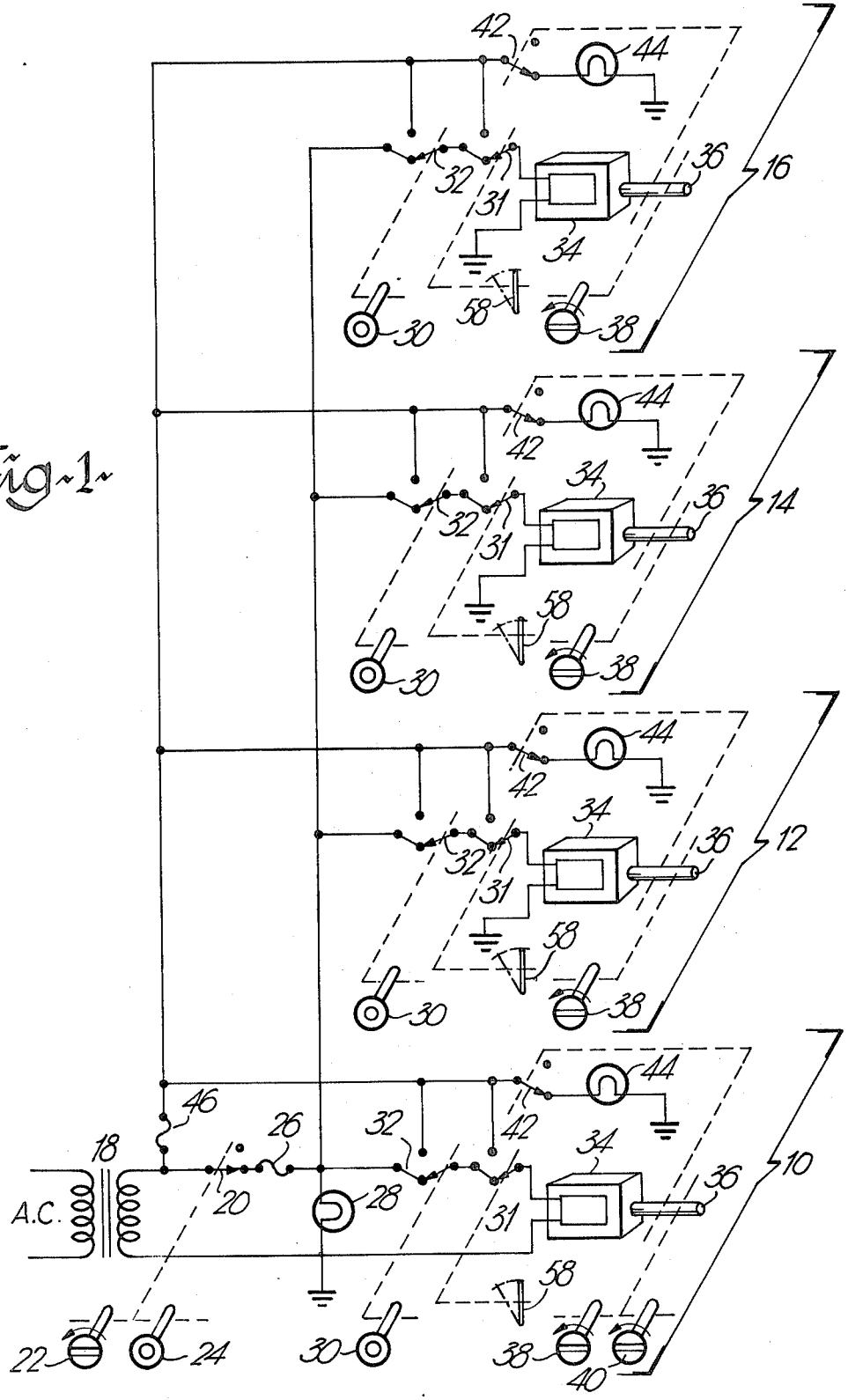
FIG. 1 is a series of circuit diagrams for a respective series of locking elements illustrating the various switches and signal lamps employed.

Illustrated in FIG. 1 is a circuit diagram of the locking device shown as applied to a few typical doors and windows of a house. Thus circuit elements 10, 12, 14 and 16 in this case are associated with the front door, back door, master bedroom window, recreational room basement window, respectively, of a house. The device is illustrated as electrically powered by 120 v.a.c. line voltage applied to the input of an isolation transformer 18, whose output is impressed across a master control switch 20 and also through a fuse 46 to the wiper of a number of limit switches 42. The master control switch 20 is operated by either the key-operated lock 22 normally located outside of the house adjacent to the most commonly used door, or a push-button switch 24 normally located on a master control panel adjacent to the most commonly used door inside the house. When the switch 20 is closed, a.c. voltage from the output of the isolation transformer is impressed via a fuse 26 across a "system on" signal lamp 28. The foregoing voltage is also impressed across the terminals of each solenoid 34 through an associated local control switch 32 which is controlled by a push-button switch 30, located near an individual window or door associated with that particular solenoid. Each solenoid plunger 36 is coupled to an associated manual override lever 38 located on the interior of the house adjacent to its associated door or window. A key-operated manual override control 40 located near master control switch 40 at the exterior of the house which in the example of FIG. 1 is adjacent to the front door, is also coupled to the front door solenoid plunger 36. One or more of the other doors or windows may also be provided with associated outside key-operated manual override controls coupled to respective solenoid plungers 36, but all doors and windows would normally be provided with inside manual override levers 38 for use in the event of a power failure. A.c. output voltage from the isolation transformer 18 is also impressed via a fuse 46, in parallel through a series of limit switches 42 associated with each locking element across respective display lamps 44. The limit switches 42 are also coupled to respective plungers 36 of the solenoid 34.

FIG. 1 also may include a retainer switch 31 shown controlled by a door 58 but which may also be controlled by a window which operates in series with an associated local control switch 32. When door 58 is closed retainer switch 31 closes the circuit between the wiper arm of local control switch 32 and the solenoid winding 34. When door 58 is left ajar, retainer switch 31 closes the circuit between the transformer output 18 applied through fuse 46 and the winding of solenoid 34.

Figure 2:
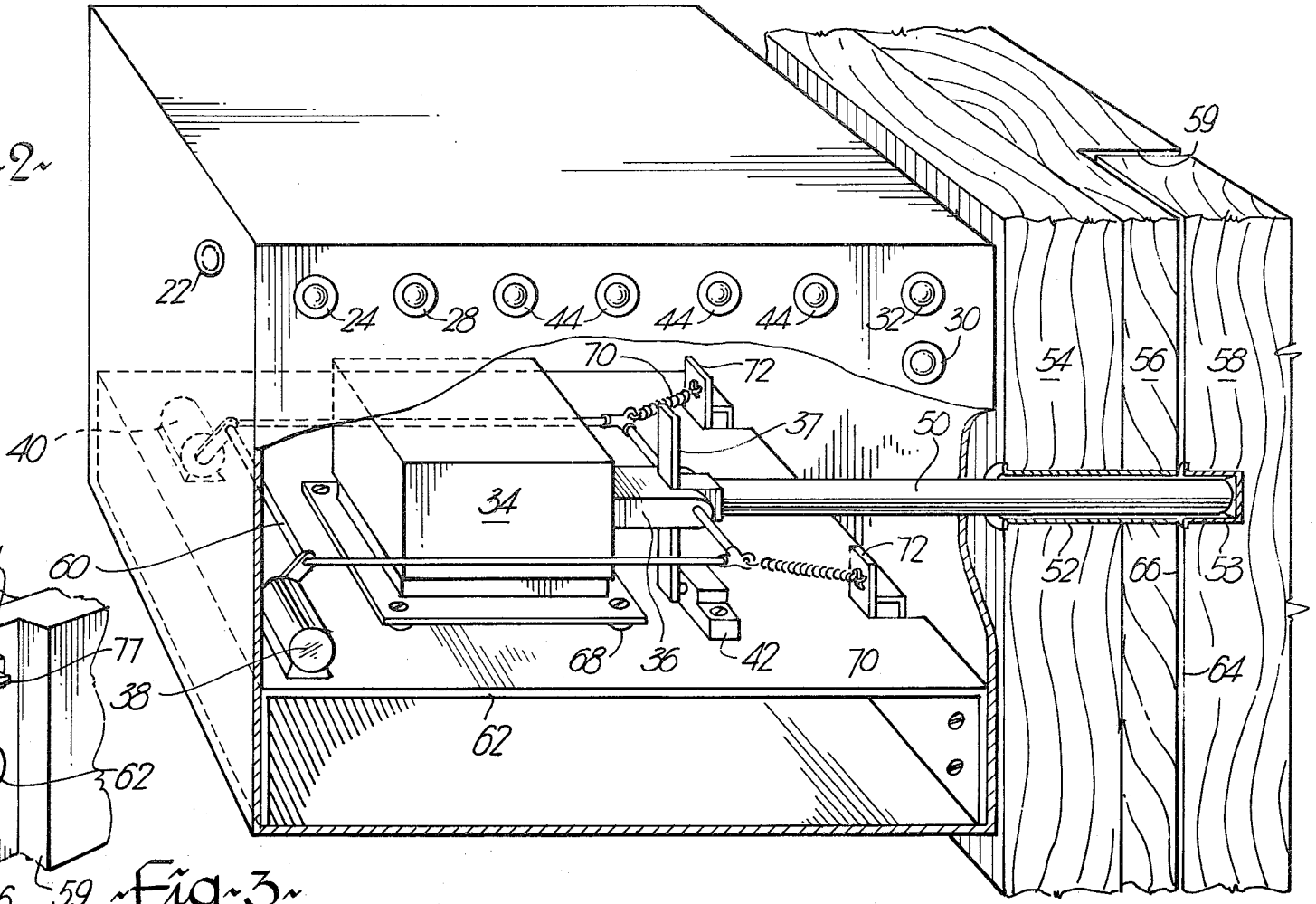
FIG. 2 is a detailed perspective view of the operational components associated with a door-locking element.

Illustrated in FIG. 2 are typical construction details of a door 58. The free vertically disposed edge 64 of the door 58 closes against a shoulder 59 (seen in FIG. 3) formed in the adjacent edge 66 of a door jamb 56. Adjacent to the door jamb 66 on the side opposite the door 58 is a vertically disposed door frame element 54 normally constructed from 2×4's. The locking element for the door 58 is mounted on the horizontally extending plate portion of a mounting bracket 62, the vertical portion of which is screwed to the side of the vertically extending door frame element 54 on the side opposite to the door jamb 56. Affixed by means of resilent mounts 68, such as rubber, to the upper surface of the bracket 62, which may typically be made of aluminum is a solenoid 34 whose plunger 36 is slideable horizontally in a vertical plane, parallel to the wall and disposed so that a deadbolt 50 made of ⅜ inch polished steel or brass rod coupled to the plunger, slides within a copper sleeve 52, which extends through the door frame element 54 and the door jamb 56. In its locking position, deadbolt 50 is inserted into a copper sleeve 53 which extends approximately ½ inch into the vertical free-swinging edge of the solid-core door 58. Also coupled to the solenoid plunger 36, is a linkage 60 coupling the plunger to inside and outside located manual override controls 38 and 40 respectively. At either end of the portion of the linkage 60 passing through the solenoid plunger 36 are attached ¼ inch diameter extension springs. The other ends of these springs are attached to respective brackets 72 affixed to the aluminum mounting bracket 62 such that the extension springs 70 act on the linkage 60 so as to cause the deadbolt 50 to move into copper sleeve 53. A micro-switch 42 is mounted on the aluminum mounting bracket 62 in a position such that when the solenoid plunger 36 is fully extended, a vertically disposed cross member 37 of the plunger contacts and closes the micro-switch 42. The micro-switch 42 in closed position closes the circuit between transformer output 18 applied through fuse 46 and the display lamp 44.

Figure 3:
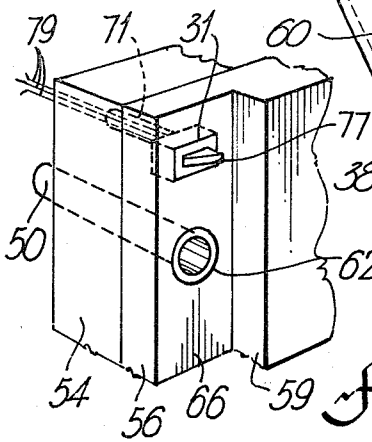
FIG. 3 is a detailed perspective view of one embodiment of restraining means which incorporates a retainer switch.

FIG. 3 illustrates the location of retaining means incorporating a retainer micro-switch 31 flush mounted on the door jamb 66 with its pivotal arm 77 extending into the space normally occupied by the door 58 when in its closed position. With the door 58 ajar or in open position, pivotal arm 77 swings out causing micro-switch 31 to close the circuit between transformer output 18 applied through switch 46 and the winding of solenoid 34. Retainer switch wires 77 run along a passageway 71 drilled through the door jam 56 and door frame element 54 to the area in which the solenoid 34 is mounted.

Figure 4:
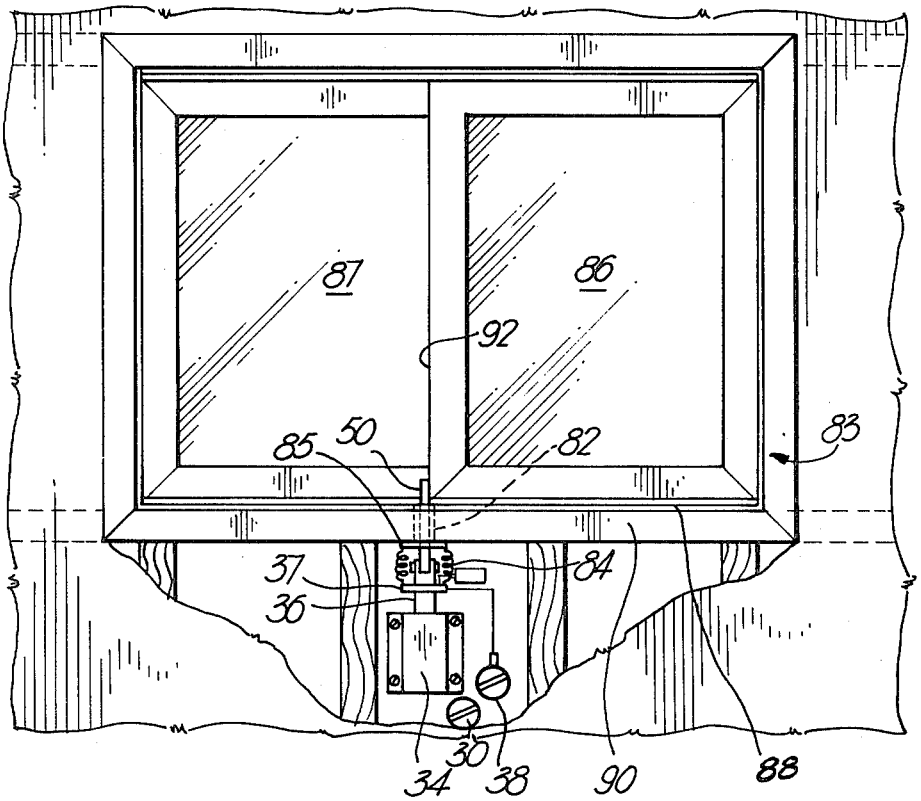
FIG. 4 is a detailed perspective view of one embodiment of a locking element of a sliding window according to the invention.

A window-locking element is illustrated in FIG. 4 wherein a solenoid 34 is mounted beneath a horizontal bottom frame element 90 of a typical sliding aluminum window having a fixed portion 87, and a slideable portion 86. The solenoid is so mounted that its plunger 36 extends in a vertical direction and is positioned such that, when the slideable portion 86 of the window 83 is in a closed position, a deadbolt 50 coupled to the solenoid plunger 36, if fully extended, extends approximately ½ inch past the top of the bottom frame element 90 adjacent to and contiguous with the vertical edge 92 of the window casement of the slideable portion 86 of the window 83. A copper sleeve 82 which slideably houses plunger 36 extends vertically through the horizontal bottom frame element 90, and constrains horizontal movement of the deadbolt 50. Ends of retaining springs 84 are attached to respective ends of a transverse member 37 affixed to the solenoid plunger 36 and the other ends of retaining springs 84 are attached to respective brackets 85 at their other end positioned so that the force of the spring pulls plunger 36 vertically upwards towards the window 83. The solenoid plunger 36 is also coupled to a manual override control 38 which can be either lever-operated or key-operated. The manual override control 38 is normally mounted on the interior portion of the wall containing the window 83.

Figure 5:
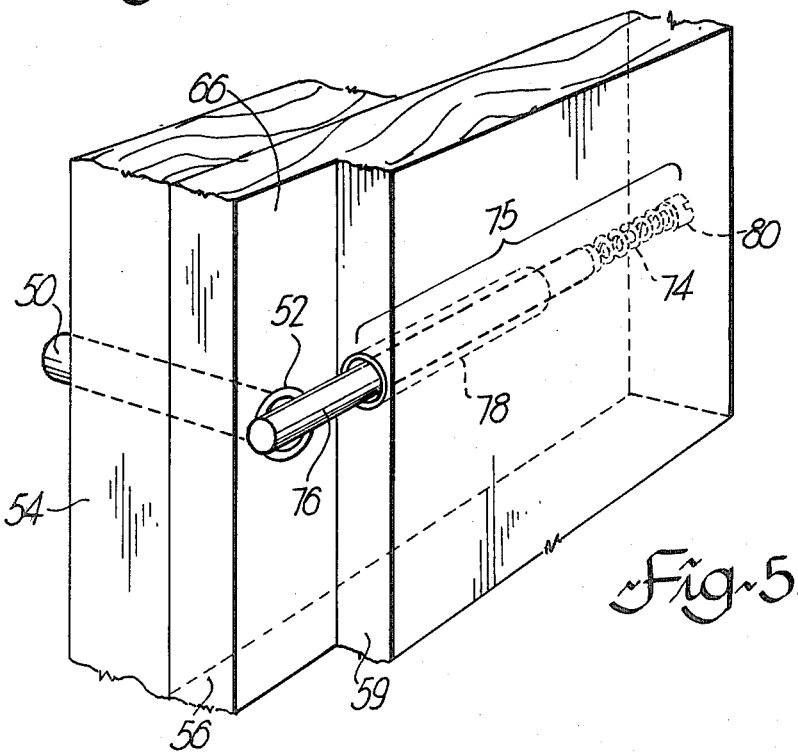
FIG. 5 is a detailed perspective view of an alternative embodiment of restraining means incorporating a mechanical plunger to prevent movement of the deadbolt to its "lock" position.

FIG. 5 illustrates the positioning of an alternative retaining means 75 with respect to the door jamb 56. A horizontally extending copper sleeve 78, housing a plunger rod 76 is positioned in the shoulder 59 of the door jamb 56 such that its central longitudinal axis is perpendicular and intersects that of the copper sleeve 52 housing the deadbolt 50. The positioning of the retaining element 75 within the door jamb 56 is such that the plunger rod 76 slideable within the retaining element copper sleeve 78 has a free end, which when the door is ajar, is forced into the space normally occupied by the closed door by a compression spring 74 acting on the opposite end of the plunger rod 76. The spring 74 is attached to a self-threading plug 80 at the end of the copper sleeve 78 opposite to the plunger rod 76. In its fully extended position, the plunger rod 76 extends across and adjacent to the end of the copper sleeve 52 which houses the deadbolt 50.

In operation, when the master control switch 20 is closed either by operation of the key-operated control lock 22 normally located at the outside of the front door or the push-button control switch normally located on the master control panel at the inside of the front door, power is applied across the signal lamp 28, causing it to light up and indicate that power is being applied to the system. Output a.c. voltage from the isolation transformer 18, applied through fuse 26 and a local control switch 32 across the leads of a solenoid 34, causes the solenoid plunger 36 to retract within a slot contained in the solenoid 34. The retraction of the solenoid plunger 36 causes retraction of a deadbolt 50 coupled thereto and unlocks the respective windows and doors to which the locking circuit elements 10, 12, 14 and 16 are associated. The operation of locking all of the windows and doors is effected normally by pressing the push-button master control switch 24, which causes switch 20 to open and remove power from the system, thereby causing system signal light 28 to go out and allowing extension springs 70 to pull out the solenoid plunger 36 from its receptacle within the solenoid 34. Advancement of the solenoid plunger 36 thereby causes deadbolt 50 to which it is coupled, in the case of a door, to project within the copper sleeve 53 contained within the door, or in the case of a window, to project against the vertical edge 92 of the slideable portion 86 of the window 83. Optionally, a second window solenoid may be placed in a similar way to the first but spaced apart therefrom to allow locking of the window at a predetermined open position. The latter optional arrangement would allow placement of the window in a slightly open position for purposes of allowing circulation of outside air. When the system is in the locked position, it is possible to unlock any one of the doors or windows independently of the master control system by operation of a push-button switch 30 which is coupled to a local control switch 32 switching of the local control switch 32 from the position shown in FIG. 1 applies power to the solenoid 34 through fuse 46 and thereby causes retraction of the solenoid plunger 36 and unlocking of its associated door or window. Additionally, in the event of a power failure which normally results in the locking of all doors and windows, manual override controls are provided which allow manual unlocking of any door or window by means of, in the case of the front door, a key-operated override control 40, located on the outside of the house usually adjacent to the front door, coupled to the solenoid plunger 36, or for any of the doors or windows, a lever control 38 located on the inside of the house adjacent to its associated door or window also coupled to the solenoid plunger 36. When the solenoid plunger 36 is fully extended by the extension springs 70, it contacts the arm of a micro-switch 42 thereby providing power to a signal lamp 44 associated with that particular micro-switch 42 causing the latter to light up thereby indicating that respective doors and windows are in a locked position. System fuses 26 and 46 are provided to protect against short circuits drawing excessive current from the isolation transformer 18.

The retaining means illustrated in FIG. 3 which incorporates retainer switch 31 is shown controlled by the movement of an associated door 58 but may equally well be controlled by a movable window. Upon opening of door 58, pivotal arm 77 swings out into the space normally occupied by the door and causes the circuit between the transformer output 18 as applied through fuse 46 and the winding of solenoid 34 to be closed thereby causing current to flow through the solenoid windings and the deadbolt 50 to retract. Pivotal arm 77 is mounted so that it has no projecting surface which could prevent closing of door 58. When door 58 is closed, pivotal arm 77 is forced to retract within the body of retainer switch 31 and to thereby close the circuit between the wiper arm of local control switch 32 and the winding of solenoid 34. In the latter position, the door 58 is controlled by local control switch 32 and master control switch 20.

In the case of a window, the bottom edge of the casement 88 of the slideable portion 86 of the window 83 acts as the restraining block to prevent movement of the deadbolt 50 when the slideable portion 86 of the window 83 is in an open position. In the latter position, switch 42 would be left open leaving lamp 44 off and thereby indicating that the window is open or ajar. A second solenoid spaced apart from the first and operable independently therefrom may be incorporated to allow locking of the window in predetermined open position and thereby provide circulation of outside air through the room. In the case of a swinging window, a retaining means incorporating a retainer switch 31 may be used. The latter retaining means, however, is applicable to a window or door that either slides or swings open. Normally, the signal lamps 44 together with a push-button master switch 24 are housed in a master control panel adjacent to the front door on the interior of a house.

The alternative retaining means 75, illustrated in FIG. 5, in the case of a door is activated by the opening of the door 58. When the door 58 is opened, it allows the plunger rod 76 to be pushed out of a copper sleeve 78 housing the plunger 76 by its associated compression spring 74. The plunger 76 then extends across the opening of the copper sleeve 52 housing the deadbolt 50, thereby preventing the deadbolt 50 from being pushed out of copper sleeve 52. When the door 58 is subsequently closed. it pushes the plunger rod 76 back into the copper sleeve 78 and the vertical free swinging edge 64 of the door 58 thereafter restrains movement of the deadbolt 50 until such time as the copper sleeve 53 within the door 58 is aligned with the portion of the copper sleeve 52 passing through the door jamb 56.

Usually the locking device is installed during the construction of the house to facilitate the installation of wires as well as locking elements. However, in view of the compact localized nature of the locking elements, the system can also be installed with a minimum amount of damage to a house for which construction has been completed. It should also be noted that when a door or window is left ajar and the associated solenoid plungers 36 are prevented from being extended, the associated limit switch 42 is not closed and the associated signal light 44 does not light up.

It is obvious from the foregoing that more than one master panel may be employed and the number of circuit elements expanded as required for a particular application. For example, panels may be installed at the back door, at the front door and in the master bedroom. Moreover, the device may be provided with a standby power source such as a battery which would automatically power the system in the event of failure of the line voltage. Clearly, the system can be applied to locking elements other than deadbolts without departing from the spirit of the invention.

What is claimed is:

1. A remotely controlled locking device comprising:

a plurality of locking elements for locking a corresponding plurality of movable wall-opening barriers, each locking element having an individual lock-operating mechanism for selectively, reversibly driving said corresponding locking element into a locked or an unlocked position in response to "lock" or "unlock" control signals, respectively;

master control means remotely connected to each lock-operating mechanism for selectively providing to the latter said "lock" or "unlock" control signals;

display means connected to each lock-operating mechanism responsive to the condition of each locking element, for displaying said condition of each locking element;

local control means for rendering inoperative control signals provided by said master control means and for the provision of "unlock" control signals to associated lock-operating mechanisms; and manual override controls mechanically coupled to each locking element to allow manual movement of each locking element to a locked or an unlocked position.

2. A device as claimed in claim 1 wherein said lock-operating mechanism, master control means, display means and local control means are electrically operated.

3. A device as claimed in claim 2 further comprising retaining means adjacent to each wall opening reversibly closed by a corresponding one of said movable wall-opening barriers for preventing movement of said corresponding locking element from an unlocked to a locked position when said associated movable wall-opening barrier is in other than a predetermined open position in response to respective "open" and "close" control signals provided by said movable wall-opening barrier.

4. A device as claimed in claim 3 wherein said display means are comprised of a plurality of signal lights each of which is associated with a respective movable wall-opening barrier and power to which is controlled by signals provided by a respective said lock-operating mechanism.

5. A device as claimed in claim 4 wherein said locking elements are solenoid actuated deadbolts generally mounted in or adjacent to the frame surrounding a movable wall-opening barrier.

6. A device as claimed in claim 5, wherein said retaining means are retainer switches which in response to "open" control signals from respective movable wall-opening barriers removably apply "unlock" control signals to said solenoid actuated deadbolts independently of said master control means.

7. A device as claimed in claim 6, wherein said display means and said master control means are located on a master control panel located proximate to a preselected remote location.

8. A device as claimed in claim 5, wherein said movable wall-opening barriers are slideable windows and their associated retaining means are the respective lower casement edges of the slideable portions of said windows which block movement of their associated deadbolts except when said windows are in predetermined positions.

9. A device as claimed in claim 5 wherein said retaining means are a plurality of retractible plungers which upon the opening of said associated respective movable wall-opening barriers extend across the path of and thereby retain said deadbolts in unlocked positions and upon the closing of said barriers retract to unextended positions.

10. A device as claimed in claim 6, wherein power to said signal lights is controlled by the position of respective switches mechanically coupled to respective associated deadbolts.

11. A device as claimed in claim 10, wherein said manual override controls are mechanically coupled to respective deadbolts and allow manual movement of respective corresponding deadbolts into "unlocked" positions in the absence of power to respective associated solenoids.

* * * * *